United States Patent [19]

Balaban

[11] 4,394,014

[45] Jul. 19, 1983

[54] TENNIS RACKET

[76] Inventor: John A. Balaban, 4142 Graham St., Pleasanton, Calif. 94566

[21] Appl. No.: 257,992

[22] Filed: Apr. 27, 1981

[51] Int. Cl.[3] ..... A63B 49/02

[52] U.S. Cl. ..... 273/73 G; 273/73 D

[58] Field of Search ..... 273/73 R, 73 C, 73 D, 273/73 E, 73 G, 73 A

[56] References Cited

U.S. PATENT DOCUMENTS

| | | | |
|---|---|---|---|
| 1,122,159 | 12/1914 | Richey | 273/73 G |
| 1,173,588 | 2/1916 | Larocque | 273/73 D X |
| 1,542,117 | 6/1925 | Rose | 273/73 D |
| 2,610,056 | 9/1952 | Lovell | 273/73 D |
| 3,994,495 | 11/1976 | Stoffel | 273/73 A X |

FOREIGN PATENT DOCUMENTS

| | | | |
|---|---|---|---|
| 639932 | 3/1928 | France | 273/73 D |
| 212195 | 3/1924 | United Kingdom | 273/73 D |
| 237395 | 7/1925 | United Kingdom | 273/73 D |
| 1444292 | 5/1966 | United Kingdom | 273/73 D |

*Primary Examiner*—Richard C. Pinkham
*Assistant Examiner*—Matthew Schneider
*Attorney, Agent, or Firm*—Manfred M. Warren; Robert B. Chickering; Glen R. Grunewald

[57] ABSTRACT

A tennis racket having string receiving holes in coaxial opposed pairs and having a slot in the throat between the bow and the handle through which the axes of holes pass so that strings can be pulled to the proper tension during stringing of the racket without frictional contact with the holes.

4 Claims, 6 Drawing Figures

TENNIS RACKET

BACKGROUND OF THE INVENTION

The familiar form of a tennis racket includes a bow, an assembly including a shaft, a pallet and a grip that will hereinafter be called a handle, and a throat that connects the bow to the handle. The bow is usually a hoop-like element elongated in the direction of the axis of the handle and having holes drilled through it to accept racket strings. The holes in the bow are drilled opposite each other across the bow so that a group of strings each passing through a hole and its matching hole on the other side of the bow will form a rectilinear pattern when the racket is strung.

In stringing a racket one or two pieces of string are passed back and forth to form all the main strings and all of the cross strings. Each though only one or two continuous strings are used, a single traverse of the racket bow is usually referred to as "a string".

A string traversing the bow through a pair of holes is pulled to a predetermined tension. The pairs of holes in the bow through which a traversing string is drawn are normally not coaxial. The holes are not coaxial for a number of reasons among which are that the holes through which strings are drawn where the throat connects to the bow of the racket must be drilled at rather sharp angles in order to intersect the interior of the bow at the appropriate position. Other holes are drilled at angles to avoid weakening the bow by having all holes drilled through the same grain line, and to avoid having intersecting holes at positons where main strings and cross strings are both strung across the bow, as at the corners of the rectilinear pattern.

In stringing a tennis racket the main strings are strung first. The main strings are passed through a pair of holes on opposite sides of the bow and drawn to what is desired to be the predetermined tension by exerting that amount of force on the string. When the string is tensioned it is clamped to retain that tension and the string is then passed through the next pair of holes and the tensioning and clamping process repeated. A particularly desirable manner for tensioning strings is to overstress them and relax them back to the desired tension which reduces variations in the final tension on the strings due to stretching.

The force exerted on a string to tension it within the racket desirably produces exactly that force as the tension on the string. However, at least some of the tensioning force is dissipated in the friction of the string rubbing against the sharp edge or small radius curve at the entry to a hole in the bow. Obviously, holes that intersect the rim at more acute angles cause greater friction against the string and more of the tensioning force is dissipated in overcoming friction and less of it is available to put the desired predetermined tension on the string.

The problem is even more aggravated when placing cross strings in the racket. In addition to the friction losses due to angular holes as described above, there are friction losses because the cross strings are woven through the main strings and a frictional contact is made at each intersection of the cross strings and the main strings. In fact, the friction between the main strings and the cross strings can become so severe that the strings may be weakened by the stringing process.

Among the problems encountered with tennis rackets having different tensions on different strings is that the racket will respond unpredictably when a ball is hit. If different main strings have different tensions, those that have the greatest tension will produce the greatest effect on the ball when it is struck. Also, when a racket is strung with its strings at different tensions the character of the racket changes as it is used. Expert tennis players thus have to "break-in" a newly strung tennis racket by playing with it before it can be used in serious competition. The breaking in causes the different string tensions to equalize somewhat.

In an effort to produce uniform and predictable tension in tennis racket strings many devices and techniques have been employed. One technique, as mentioned above, is to overstress the string and to approach the proper predetermined tension by relaxing the string to the wanted tension rather than tensioning it to that point. However, whether the desired tension is approached by pulling or relaxing the string, friction always absorbs an unknown of the tensioning force. Another technique that has been employed to diminish the influence of friction is to deflect the main strings when the cross strings are being tensioned so that tension is applied to the cross strings without encountering friction between the cross strings and the main strings. Both of these techniques are useful in the device and process of this invention.

As mentioned above, the response to a tennis racket to striking a tennis ball varies with the tension of the strings and with the difference in tension among the strings. The position on the racket strings where the response to striking the ball is most effective is known as the "sweet spot". Striking the ball in the sweet spot not only gives a desirable and predictable response and good control but it also creates a good subjective feel. It is, accordingly, desirable to enlarge the sweet spot. Recently developed tennis rackets have enlarged the sweet spot by making a larger bow for the racket. Longer strings create a larger sweet spot. In rackets strung with the strings passing through angular holes, the effective length of the racket string is the distance across the inside of the bow between each pair of holes.

SUMMARY OF THE INVENTION

This invention is an improved tennis racket having the desired, predetermined tension on all strings. The device of this invention results in a tennis racket that has all strings at the proper tension, does not require a breaking-in period, and which produces a tennis racket having a larger sweet spot. The tennis racket of this invention includes a bow, a handle, and an interconnecting throat in their usual relationship to one another. The bow has a rim drilled with pairs of holes to receive strings and each pair of holes on opposite sides of the bow, which receive opposite ends of the same string, have the same long axis. The throat of the tennis racket of this invention is provided with one or more narrow slots that underlie the holes drilled in the bow that intersect the throat. The slot or slots in the throat are positioned to intersect holes in the bow of the tennis racket and the plane of the slot is parallel to the plane in which the axes of those holes lie.

The tennis racket made in accordance with this invention may be strung by passing a string through a pair of coaxial holes and tensioning the string without friction against the interior of the hole or the opening of the hole at the interior of the bow of the racket. Thus, if a given force is placed on the string to provide tension, exactly that amount of force will tension the string and none will be dissipated in overcoming friction. If the string is overstressed and relaxed to that predetermined tension, the tension will remain more reliably on the string and will not be as subject to changing due to stretching of the string. When a tensioned string is stretched across the bow of a tennis racket it is clamped by known means to maintain the tension in the string, the string is then passed across the outside of the bow of the racket and passed through the next adjacent hole and its opposed pair member across the bow, and the tensioning process is repeated. As will be seen from the following discussion, every time a string is pulled with the appropriate predetermined tension, it is pulled either completely straight or substantially straight so that there is substantially no drag or friction dissipating the tensioning force. After all of the main strings have been drawn to the proper tension, cross strings are installed and when they are tensioned the main strings are deflected out of the path of the cross strings to permit drawing the cross strings through coaxial holes and out of contact with the main strings whereby each cross string will be pulled to have exactly its predetermined tension. Main strings are generally all pulled to the same predetermined tension and so are cross strings, but the predetermined tension on main strings is usually different from that on cross strings.

It is evident that when all strings of the same category are at the same predetermined tension, a break-in period is not needed. Since all strings are tensioned with the same force any changes in tension due to stretching or variations in temperature or humidity or other conditions will influence all strings the same to preserve the uniform response when a ball is struck. It is also evident that strings drawn through coaxial holes will be free to respond to striking a ball between contact points with the bow of the racket and that those contact points will be on the outside of the bow rather than the inside. As a result, the effective length of each string is the distance from the outside of the bow on one side of the string to the outside of the bow on the other side of the string. The thickness of the bow of an ordinary wooden tennis racket is approximately one-half inch so that the effective length of each string in a racket made in accordance with this invention will have at the least an effective length approximately one inch greater than the effective length of a string in a known racket of the same size and shape.

DETAILED DESCRIPTION OF THE INVENTION

The device and method of this invention may be better understood with reference to the accompanying drawings.

Figures 1, 2:
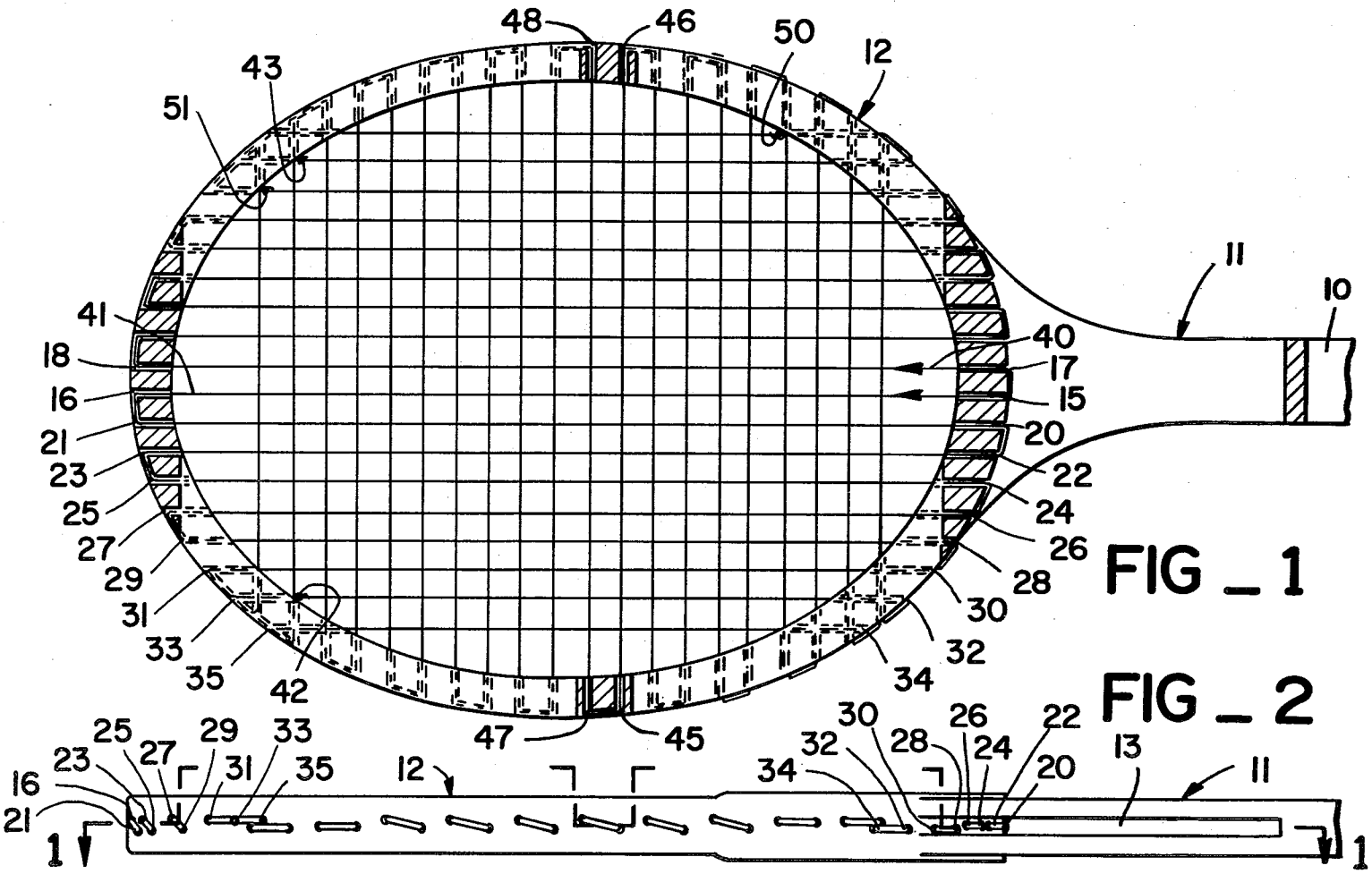
FIG. 1 is a sectional view of a tennis racket embodying this invention and taken along the line 1—1 of FIG. 2.
FIG. 2 is a left side view of the tennis racket illustrated in FIG. 1.

The tennis racket illustrated in FIGS. 1 and 2 consists generally of a handle 10, a throat designated 11, and a bow designated generally as 12. The tennis racket illustrated in FIGS. 1 and 2 has the same overall shape and size of an ordinary tennis racket. However, the throat 11 is provided with a slot 13 (FIG. 2) passing entirely through it. As can best be seen in FIG. 2, the slot underlies the holes through the bow 12 so that those holes open within the slot. The width of the slot 13 must be large enough to contain the openings of the holes in the bow 12. Those portions of throat 11 above and below the slot 13 as illustrated in FIG. 2 can readily be made of sufficient thickness and strength to maintain the structural connection between the handle and the bow 12 during use of the tennis racket.

The tennis racket illustrated in FIGS. 1 and 2 is strung in accordance with the familiar rectilinear pattern for stringing tennis rackets. However, the holes in the bow 12 through which it is strung are arranged through the bow in coaxial pairs. Thus, hole 15 and hole 16 are drilled with the same longitudinal axis and hole 17 is on the same longitudinal axis as hole 18. Holes 15 and 17 open within the slot 13 while holes 16 and 18 open within the familiar recessed grooves which shield the strings from direct contact with the court or other surfaces. Each other main string is strung through a pair of coaxial holes. Thus, holes 20 and 21 are a coaxial pair, holes 22 and 23 are a coaxial pair, holes 24 and 25 are a coaxial pair, holes 26 and 27 are a coaxial pair, holes 28 and 29 are a coaxial pair, holes 30 and 31 are a coaxial pair, holes 32 and 33 are a coaxial pair, and holes 34 and 35 are a coaxial pair. A symmetrical arrangement on the other side of the bow 12 is employed. The axes of holes 22,24 and 26, for example, pass through the throat to the exterior of the racket without contacting any portion of the handle.

It is evident that without the slot 13 in the throat of the tennis racket of this invention, the holes 17, 15, and 20 would necessarily have to be drilled through the throat 11 at an angle in order to open at an appropriate position in the interior part of the bow 12 to have strings drawn across the racket bow as pictured in FIG. 1. The tennis racket of this invention permits strings to be drawn through coaxial pairs of holes as described without encountering any friction with the bow.

Employing the tennis racket of this invention, the entire racket may be strung by applying tension without substantial friction either against holes. The racket may be strung with one continuous string, or, as is preferred, it may be strung with one string for all of the main strings of the racket and a different string for all of the cross strings of the racket. A preferred method for stringing the racket illustrated in FIG. 1 is to find the center portion of the string that will form the main strings of the racket and to position that center portion between hole 15 and hole 17. The string can be clamped at a position 40 and the end portion is then passed through hole 16. In that position the force can be exerted on the string in the direction indicated by the arrowhead, in other words pulling away from hole 15 and toward hole 16. In a preferred embodiment of the invention, the string is tensioned beyond the desired tension and then relaxed back to the desired predetermined tension on the string. For example, if the racket is to be strung with a string tension of 40 pounds, the string between hole 15 and hole 16 is pulled to 50 pounds and relaxed back to 40 pounds. The string at the interior opening to hole 16, indicated as point 41, is then clamped to maintain that tension and the end of the string is passed through hole 21 and hole 20. The string can be pulled straight through hole 20 and miss any portion of the handle 10. The string passing between holes 21 and 20 can be pulled straight through both coaxial holes without encountering friction either from the sides of the holes 21 and 20 or the openings of those holes to the interior bow 12. Thus, proper tension put on the string between holes 20 and 21 will be exactly the tension applied and none of the force applying the tension will be dissipated in overcoming friction. After the proper tension is obtained by overstressing the string, relaxing it, and clamping it, the string is passed between holes 22 and 23, another coaxial pair, and the process of stretching and clamping is repeated. The string is passed back and forth between the various pairs of coaxial holes and is finally tied off at 42 after passing, in the usual way, through hole 35 and then doubled back through hole 33 is illustrated. When the racket is strung as stated above, the mirror image of that technique is employed first by passing the string through holes 17 and 18 and then successively through the coaxial pairs until the racket is completely strung with main strings and tied off at position 43.

Tennis racket embodying this invention preferably have the cross strings put in place by first employing a device that bends the alternate main strings in alternate directions far enough so that a cross string can be stretched between a pair of coaxial holes without troughing the main strings. A single string can be passed back and forth between coaxial pairs of cross string holes so that, ultimately, the racket strung as pictured in FIG. 1 is prepared. The portion of the bow illustrating coaxial holes in cross section for the cross strings shows a coaxial pair of holes 45 and 46 and a coaxial pair of holes 47 and 48 illustrating not only how the strings can be drawn under the proper tension without friction against the holes in the bow, but also how the strings lie in grooves so they do not extend beyond the confines of the outer periphery of the bow 12. The cross strings are tied off at 50 and 51 whereupon the entire racket is strung. A tennis racket strung as set forth above is strung with precisely the desired predetermined tension on each string. The racket thus strung does not have to be broken in. In addition, the racket thus strung has exactly the desired predetermined tension on each string so that it will always respond the same when used immediately after stringing. Other devices known to the art may be employed to insure that the stringing procedure produces predictable tension on each string of the racket. These devices include clamping means and tensioning devices as well as braces to prevent the racket from becoming more circular and less elongated when the main strings are installed. The tennis racket of this invention will produce the desired result of uniform string tension in the racket to a better degree when such other known devices are employed. It is also evident from FIGS. 1 and 2 that each spring is free to respond within its pair of coaxial holes. As a consequence, the effective length of each string is the distance between the outside bow contact points, and this greater effective string length produces a larger sweet spot.

Figure 3:
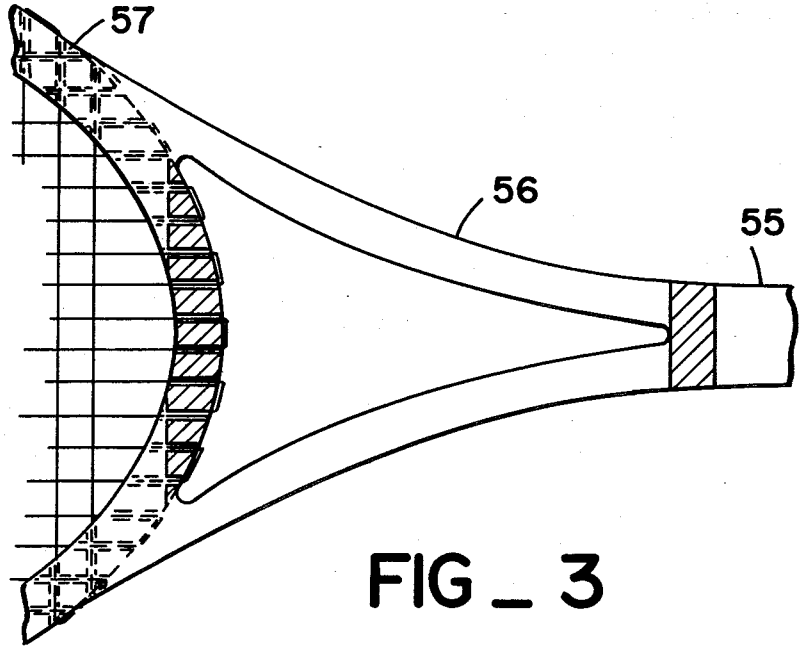
FIG. 3 is a sectional partial view of a tennis racket embodying this invention and taken along the line 3—3 of FIG. 4.
Figure 4:
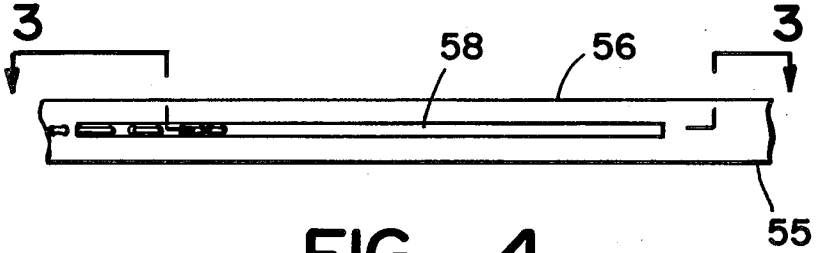
FIG. 4 is a side view of the tennis racket illustrated in FIG. 3.

FIGS. 3 and 4 illustrate partially another racket made in accordance with this invention. The tennis racket illustrated in FIGS. 3 and 4 is of the convention open-throat design. The racket illustrated in FIGS. 3 and 4 includes a handle 55, a throat 56, and a bow 57. The handle 55 and the bow 57 are the same as illustrated in FIGS. 1 and 2 but the throat 56 is split. The split throat 56, especially visible in FIG. 4, has an elongated slot 58 through which the main strings of the racket may be drawn during a stringing procedure. It is evident from examination of FIGS. 3 and 4 that a stringing procedure such as the one described with reference to FIGS. 1 and 2 can be performed in that all strings can be tensioned by force that is coaxial with each coaxial pair of holes through which the string passes. The racket illustrated in FIGS. 3 and 4 is illustrated showing only the main strings in place.

Figure 5:
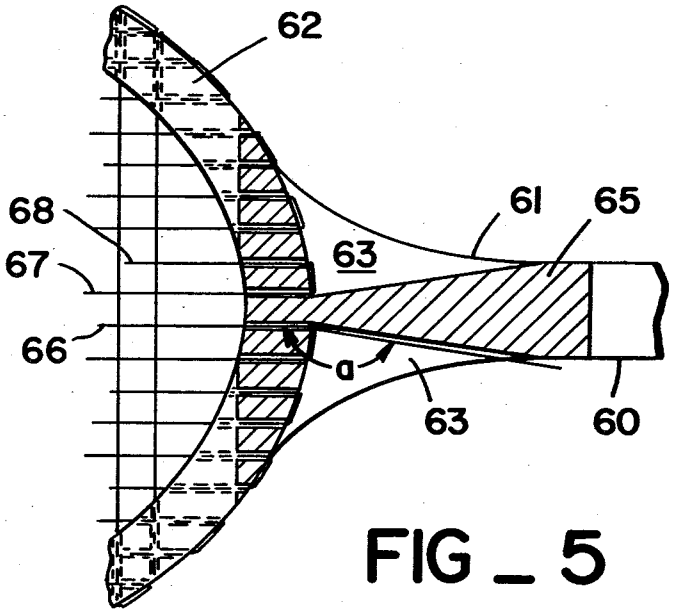
FIG. 5 is a sectional partial view of a tennis racket taken along the line 5—5 of FIG. 6.
Figure 6:
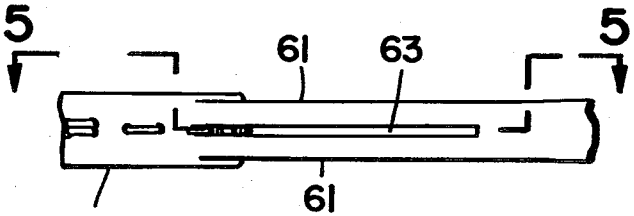
FIG. 6 is an end view of the tennis racket illustrated in FIG. 5.

FIGS. 5 and 6 illustrate another tennis racket embodying this invention. In the device of FIGS. 5 and 6 there is a handle 60, a throat 61 and a bow 62. The racket illustrated in FIGS. 5 and 6 is provided with a slot 63 that does not go entirely through the throat. A solid central portion 65 is provided for extra strength if desired. In stringing the racket illustrated in FIGS. 5 and 6, it will be necessary to tighten strings 66 and 67 by pulling them toward the handle 60. As the racket is built, it will be necessary to pull each of string 66 and 67 at a slight angle illustrated as "a" in order to provide tension. The angle "a" is so close to 180° that the friction produced by the string 66 rubbing against the side of the hole in the bow is almost negligible. It is evident that the closer the angle "a" is to 180° the smaller the effect on tension.

String 67 will be pulled in the same manner as string 66, threaded through the next hole where it becomes string 68 which can be pulled with the force of the tensioning exactly coaxial with the hole through which it is pulled and on the reverse pull of that string there will be no portion of the throat or handle to interfere with applying tension coaxial with both of the holes through which the string is drawn.

What is claimed is:

1. A tennis racket having a handle, a bow, and a throat which connects the handle and the bow, said bow having pairs of coaxial holes drilled therethrough to receive strings, an open slot in said throat, said slot being wider than said strings and positioned so that the axis of a hole passing through said throat will lie within said slot, and so that the axes of at least some of said coaxial holes pass through said throat to the exterior of the racket without contacting any portion of the racket.

2. The tennis racket of claim 1 having the axes of said holes forming a rectilinear pattern.

3. The tennis racket of claim 2 having the axes of some holes parallel to the long axis of said handle.

4. The tennis racket of claim 1 having a string passing through each pair of coaxial holes with each string at a predetermined tension.

* * * * *